US006715306B2

(12) United States Patent
Cho et al.

(10) Patent No.: US 6,715,306 B2
(45) Date of Patent: Apr. 6, 2004

(54) CONCENTRATION COOLING APPARATUS OF REFRIGERATOR

(75) Inventors: Seong-Ho Cho, Seoul (KR); In-Seop Lee, Gyeonggi-Do (KR); In-Won Lee, Gyeonggi-Do (KR); Jae-Yong Sung, Seoul (KR); Jay-Ho Choi, Seoul (KR); Kwang-Hyup An, Seoul (KR); Jeong-Ho Lee, Gyeonggi-Do (KR); Young-Sok Nam, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/316,038

(22) Filed: Dec. 11, 2002

(65) Prior Publication Data

US 2004/0031276 A1 Feb. 19, 2004

(30) Foreign Application Priority Data

Aug. 14, 2002 (KR) ..... 10-2002-48259

(51) Int. Cl.[7] ..... F25D 17/04
(52) U.S. Cl. ..... 62/186; 236/49.3
(58) Field of Search ..... 62/186, 404, 407, 62/408, 89; 236/49.3; 454/108, 154, 305

(56) References Cited

U.S. PATENT DOCUMENTS 4,912,943 A * 4/1990 Hubert et al. ..... 62/374
5,737,935 A * 4/1998 Heo ..... 62/186
5,775,124 A * 7/1998 Park et al. ..... 62/408
5,778,688 A * 7/1998 Park et al. ..... 62/89
5,907,953 A * 6/1999 Kang et al. ..... 62/89
6,055,820 A * 5/2000 Jeong et al. ..... 62/186
6,622,504 B2 * 9/2003 Lee et al. ..... 62/186
2003/0131541 A1 * 7/2003 Lee et al. ..... 52/79.1

* cited by examiner

*Primary Examiner*—Marc Norman
(74) *Attorney, Agent, or Firm*—Greenblum & Bernstein, P.L.C.

(57) ABSTRACT

A concentration cooling apparatus of a refrigerator including housings respectively installed to cold air guide path formed at the side wall of a chilling chamber; a nozzle rotatably supported by the housings and jetting cold air intensively to a high-temperature load occurred region; a nozzle support member arranged with a certain distance from the outer circumference of the nozzle, connected to the nozzle through a connection rod extended from the both sides of the nozzle; an infrared temperature sensor installed on the front of the nozzle; a first driving unit for rotating the nozzle in the circumferential direction by rotating the nozzle support member; and a second driving unit for rotating the nozzle up and down by rotating the connection rod rotated according to the rotation direction of the nozzle, thereby discharging cold air intensively onto a high temperature load occurred region, cooling instantly the high temperature load.

18 Claims, 11 Drawing Sheets

CONCENTRATION COOLING APPARATUS OF REFRIGERATOR

BACKGROUND OF THE INVENTION

1. Field of the Invention

The present invention relates to a refrigerator, and in particular to a concentration cooling apparatus of a refrigerator capable of performing instant cooling operation and maintaining a temperature inside a cooling chamber uniformly by jetting cold air intensively at a high-temperature load occurred region inside the chilling chamber.

2. Description of the Prior Art

In general, a refrigerator is partitioned into a freezing chamber for storing frozen food and a chilling chamber for storing cold food, and it has a refrigerating cycle for supplying cold air into the freezing chamber and the chilling chamber.

FIG. 1 is a perspective-sectional view illustrating the conventional refrigerator, and FIG. 2 is a sectional view illustrating a chilling chamber of the conventional refrigerator.

The conventional refrigerator consists of a main body 104 on which a pair of doors 102 open/closed in two ways installed on the front; a freezing chamber 106 placed on the left of the main body 104 and storing frozen food; a chilling chamber 108 partitioned from the freezing chamber 106 by a separation wall 110, placed on the right side of the main body 104 and having plural shelves for mounting cold food; and a cold air supply unit installed at the upper portion of the freezing chamber 106 and supplying air cooled while passing the refrigerating cycle (not shown) to the freezing chamber 106 and the cooling chamber 108.

The cold air supply unit includes a fan 120 installed at the upper rear surface of the freezing chamber 106 and forcibly ventilating air cooled while passing the refrigerating cycle; a panel 128 installed at the lower portion of the fan 120 and having plural cold air discharge holes 130 for discharging cold air inside the freezing chamber 106; a cold air supply path 132 formed at the upper portion of the separation wall 110 in order to make the cold air ventilated from the fan 120 flow into the chilling chamber 108; a cold air discharge duct 134 installed at the upper portion of the chilling chamber 108, communicating with the cold air supply path 132 and discharging the air supplied from the cold air supply path 132 into the chilling chamber 108; and a cold air inflow path 138 formed at the lower portion of the separation wall 110 and making the cold air finishing the cooling operation while circulating the chilling chamber 108 flow into the refrigerating cycle.

Herein, plural cold air discharge holes 136 for discharging cold air into the is chilling chamber 108 are formed at the front and lower surfaces of the cold air discharge duct 134.

And, a temperature sensor 140 is installed at a certain side of the chilling chamber 108, when a temperature inside the chilling chamber 108 is not greater than a set value, cold air supply into the chilling chamber 108 is stopped, when a temperature inside the chilling chamber 108 is not less than a set value, cold air is supplied into the chilling chamber 108.

In the conventional refrigerator, when the refrigerating cycle is operated and the fan 120 is circulated, cold air cooled while passing the refrigerating cycle is respectively discharged into cold air discharge holes 130 of a panel 128 and the cold air supply path 132 by the ventilation pressure of the fan 120.

The cold air discharged into the cold air discharge holes 130 performs the cooling operation of frozen food stored in the freezing chamber 106 while circulating inside the freezing chamber 106.

And, the cold air supplied to the cold air supply path 132 flows into the cold air discharge duct 134 and is discharged into the chilling chamber 108 through cold air discharge holes 136 formed on the cold air discharge duct 134. The cold air discharged into the chilling chamber 108 performs the cooling operation of cold food stored in the chilling chamber 108 while circulating inside the chilling chamber 108, and the cold air finishing the cooling operation flows into the cold air inflow path 138 formed at the lower portion of the separation wall 110 and is cooled again while passing the refrigerating cycle.

However, in the conventional refrigerator, a cold air discharge duct is installed at the upper portion of a chilling chamber, cold air is supplied from the upper portion to the lower portion of the chilling chamber through cold air discharge holes formed on the cold air discharge duct, a temperature variation inside the chilling chamber is big according to a distance from the cold air discharge holes. And, because cold air is discharged only from the cold air discharge duct, when a high temperature load occurs due to foodstuff stored inside the chilling chamber, lots of time is required for equalizing a temperature inside the chilling chamber, and freshness of the foodstuff stored in the chilling chamber may be lowered due to delay in cooling.

In addition, because a temperature sensor and cold air discharge holes are fixed at a certain region, there are some difficulties to detect a temperature of a certain portions of the chilling chamber through the temperature sensor and cold air are discharged onto only limited region, herein, when a load occurs on the certain regions, lots of time is required for solving the temperature variation, and accordingly a temperature inside the chilling chamber may not be uniformly maintained.

In particular, because the cold air discharge holes are formed at the rear of the chilling chamber, cold air supply is concentrated on the rear and center portions of the chilling chamber around the cold air discharge holes, foodstuff stored on that portions may be excessively cooled, in addition, foodstuff stored on portions separated from the cold air discharge holes may be weakly cooled.

In more detail, the temperature variation inside the chilling chamber is big according to a distance from the cold air discharge holes, and accordingly a temperature distribution inside the chilling chamber may not be uniform.

SUMMARY OF THE INVENTION

In order to solve the above-mentioned problems, it is an object of the present invention to provide a concentration cooling apparatus of a refrigerator which is capable of maintaining a temperature inside a chilling chamber uniformly in a short time and maintaining freshness of foodstuff stored in the chilling chamber by installing a concentration cooling apparatus inside the chilling chamber and discharging cold air intensively on a high-temperature load occurred region inside the chilling chamber in order to improve a cooling speed on the high-temperature load occurred region.

In addition, it is another object of the present invention to provide a concentration cooling apparatus of a refrigerator which is capable of coping with a high temperature load occurred inside a chilling chamber positively by rotating a cold air jet hole for discharging cold air and a nozzle having a temperature sensor up and down as well as in the circumferential direction in order to widen a cold air discharging region of the cold air jet hole and a temperature sensing region of the temperature sensor.

In order to achieve the above-mentioned object, a concentration cooling apparatus of a refrigerator in accordance with the present invention includes housings respectively installed to at least one cold air guide path formed at the side wall of a chilling chamber in order to guide cold air to the side wall of the chilling chamber; a nozzle rotatably supported by the housings and jetting cold air intensively to a high-temperature load occurred region inside the chilling chamber when the high temperature load occurs at the certain region; a nozzle support member arranged with a certain distance from the outer circumference of the nozzle, connected to the nozzle through a connection rod extended from the both sides of the nozzle and supporting the nozzle rotatably; an infrared temperature sensor installed on the front of the nozzle, rotating with the nozzle and sensing the high-temperature load occurred region; a first driving unit for rotating the nozzle in the circumferential direction by rotating the nozzle support member; and a second driving unit for rotating the nozzle up and down by rotating the connection rod interlocked with the rotation of the nozzle and rotated according to the rotation direction of the nozzle.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Hereinafter, the preferred embodiment of a refrigerator having a concentration cooling apparatus in accordance with the present invention will be described with reference to accompanying drawings.

There can be plural embodiments of a refrigerator having a concentration cooling apparatus in accordance with the present invention, hereinafter, the preferred embodiment will be described.

Figure 1:
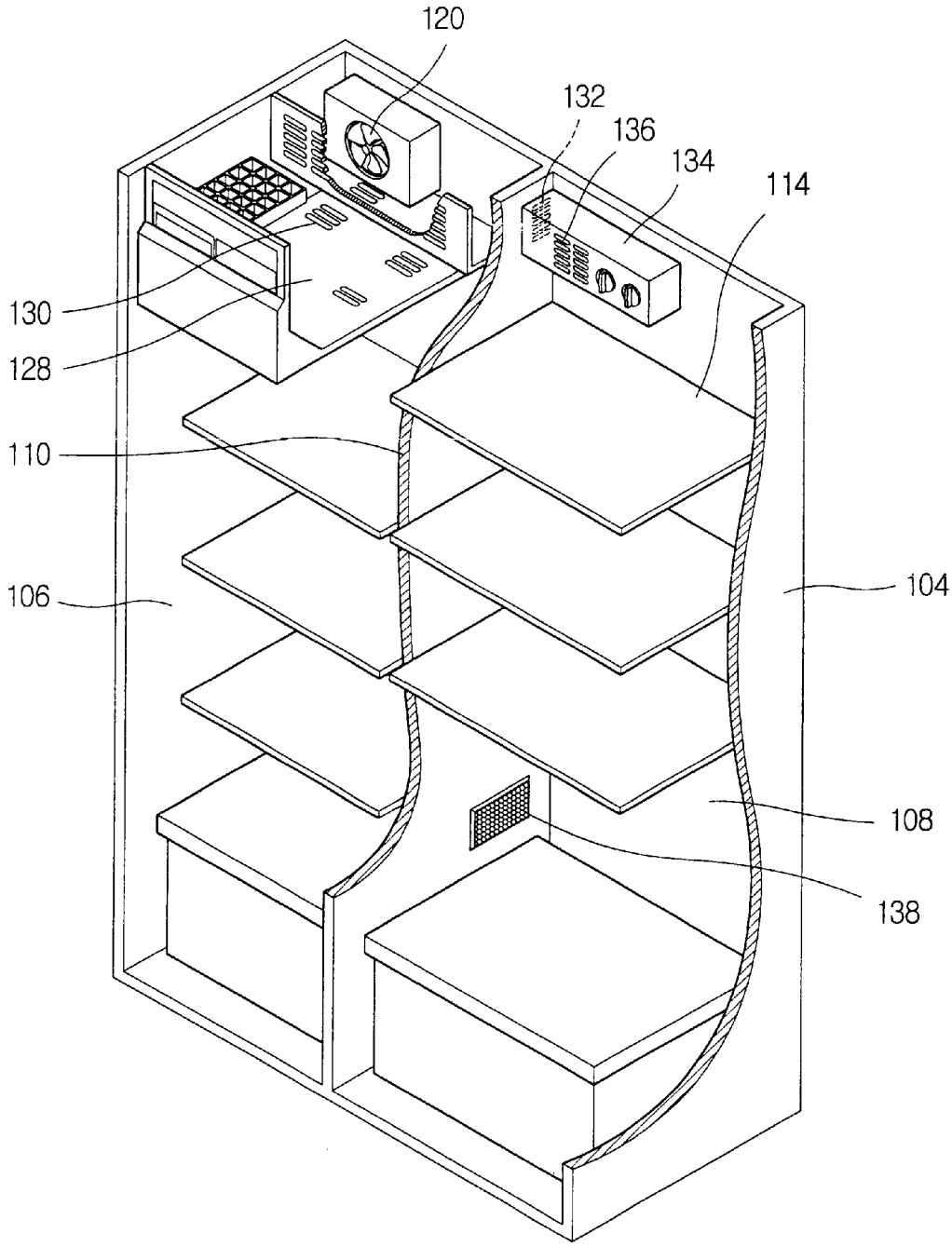
FIG. 1 CONVENTIONAL ART
FIG. 1 is a perspective-sectional view illustrating the conventional refrigerator.
Figure 2:
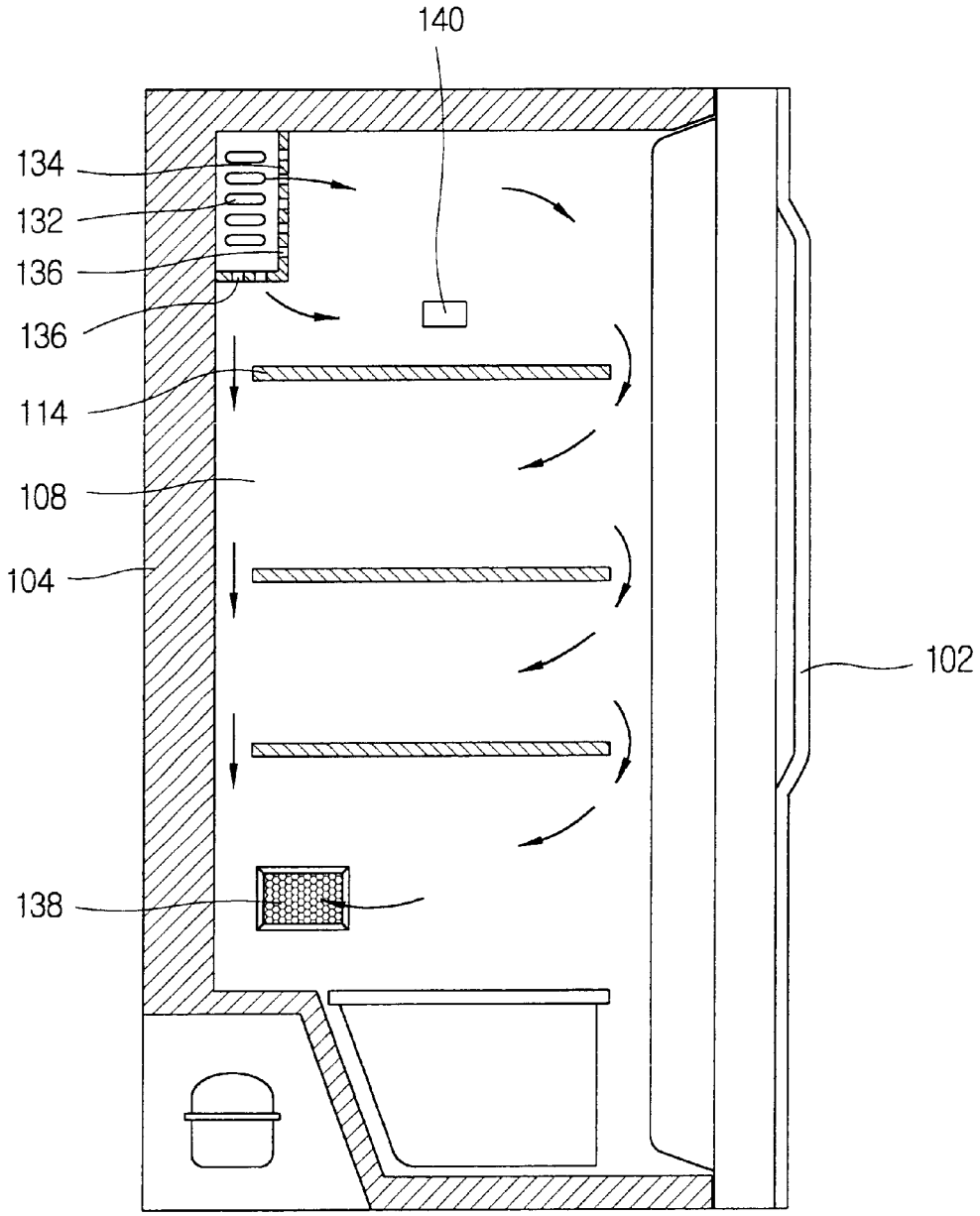
FIG. 2 CONVENTIONAL ART
FIG. 2 is a sectional view illustrating a chilling chamber of the conventional refrigerator.
Figure 3:
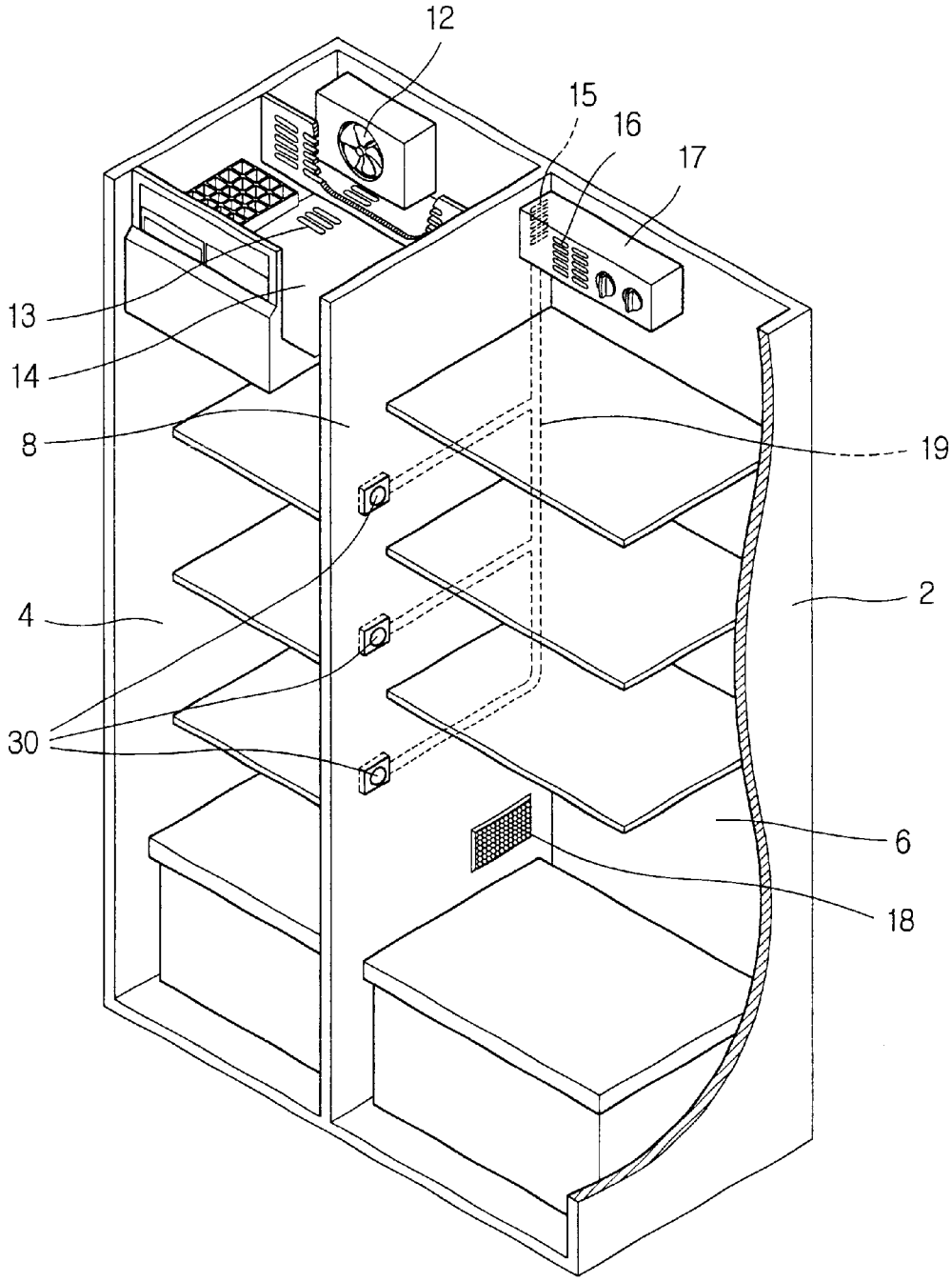
FIG. 3 is a perspective-sectional view illustrating a refrigerator having a concentration cooling apparatus in accordance with the present invention.

FIG. 3 is a perspective-sectional view illustrating a refrigerator having a concentration cooling apparatus in accordance with the present invention.

The refrigerator in accordance with the present invention includes a main body 2 on which a door (not shown) open/closed in two ways installed on the front; a freezing chamber 4 placed on the left or right of the main body 2 and storing frozen food; a chilling chamber 6 partitioned from the freezing chamber 4 by a separation wall 8 and storing cold food; a refrigerating cycle (not shown) installed at a certain side of the main body 2 and generating cold air; a cold air supply unit for supplying air cooled while passing the refrigerating cycle to the freezing chamber 4 and the cooling chamber 6; and a concentration cooling apparatus for discharging cold air intensively to a high-temperature load occurred region.

The cold air supply unit includes a fan 12 installed at the upper rear surface of the freezing chamber 4 and forcibly ventilating air cooled while passing the refrigerating cycle; a panel 14 installed at the lower portion of the fan 12 and having plural discharge holes 13 for discharging cold air from the fan 12 into the freezing chamber 4; a cold air supply path 15 formed at the upper portion of the separation wall 8 in order to make the cold air ventilated from the fan 12 flow into the chilling chamber 6; and a cold air discharge duct 17 installed at the upper portion of the chilling chamber 6, communicating with the cold air supply path 15 and having cold air discharge holes 16 for discharging cold air into the chilling chamber 6.

And, a cold air inflow path 18 is formed at the lower portion of the separation wall 8 to make the cold air finishing the cooling operation while circulating the chilling chamber 6 flow into the refrigerating cycle.

The concentration cooling apparatus consists of at least one cold air guide path 19 extended from the cold air supply path 15 and formed at the separation wall 10 in order to guide cold air to the side wall of the chilling chamber 6; and each cold air jet unit 10 connected to the cold air guide path, respectively installed at the side walls of the chilling chamber 6 and jetting cold air to the high-temperature load occurred region.

In the meantime, a damper 20 is installed on the cold air supply path 15 in order to open/cut cold air flowing into the chilling chamber 6 or open/close the cold air supply duct 17 and the cold air guide path 19 selectively.

The damper 20 has a disc shape and is rotatively installed at the upper side surface of the cold air supply path 15 by a hinge shaft 22. And, the hinge shaft 22 is connected to a driving unit (not shown), when the driving unit 22 is operated, the damper 20 is rotated.

Figure 4:
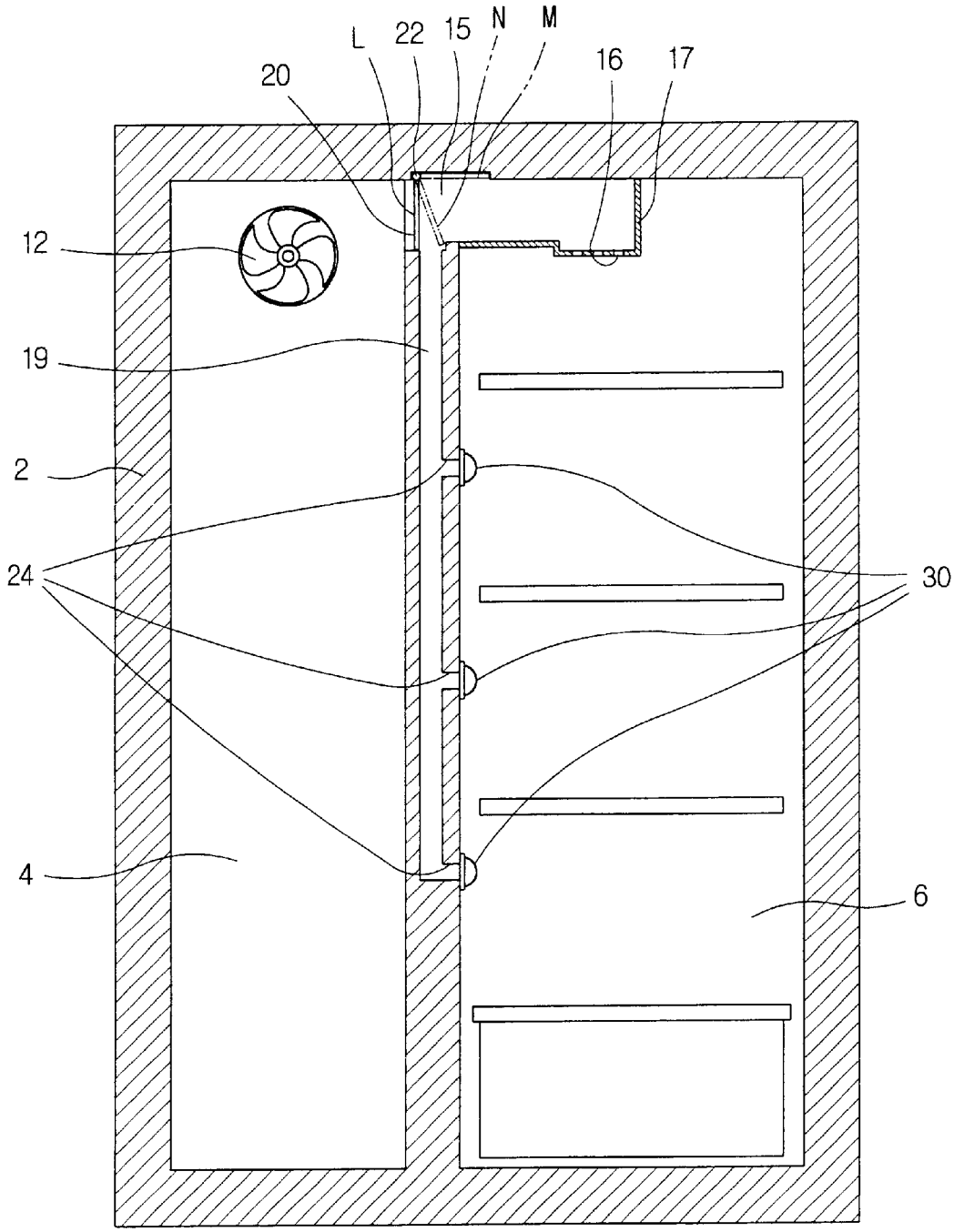
FIG. 4 is a sectional view illustrating the refrigerator having the concentration cooling apparatus in accordance with the present invention.

In more detail, as depicted in FIG. 4, by the operation of the driving unit, when the damper 20 is placed on a first position (L), cold air supply to the freezing chamber 6 is cut off, when the damper 20 is placed on a second position (M), cold air supply to the cold air discharge duct 17 is cut off, when the damper 20 is placed on a third position (N), cold air is supplied to the cold air guide path 19 and the cold air discharge duct 17.

Figure 5:
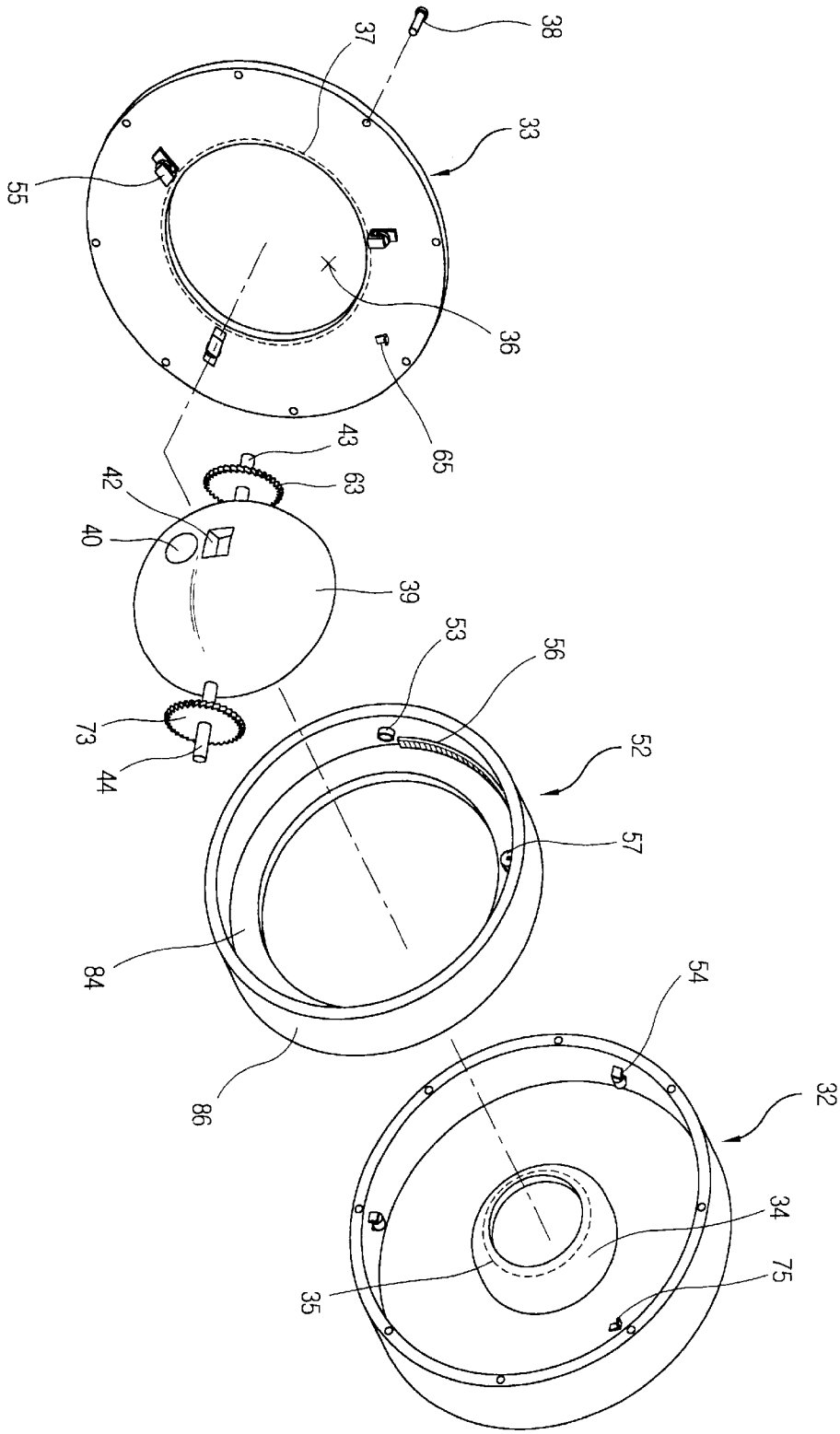
FIG. 5 is a perspective-exploded view illustrating a cold air jet unit of the concentration cooling apparatus in accordance with the present invention.
Figure 6:
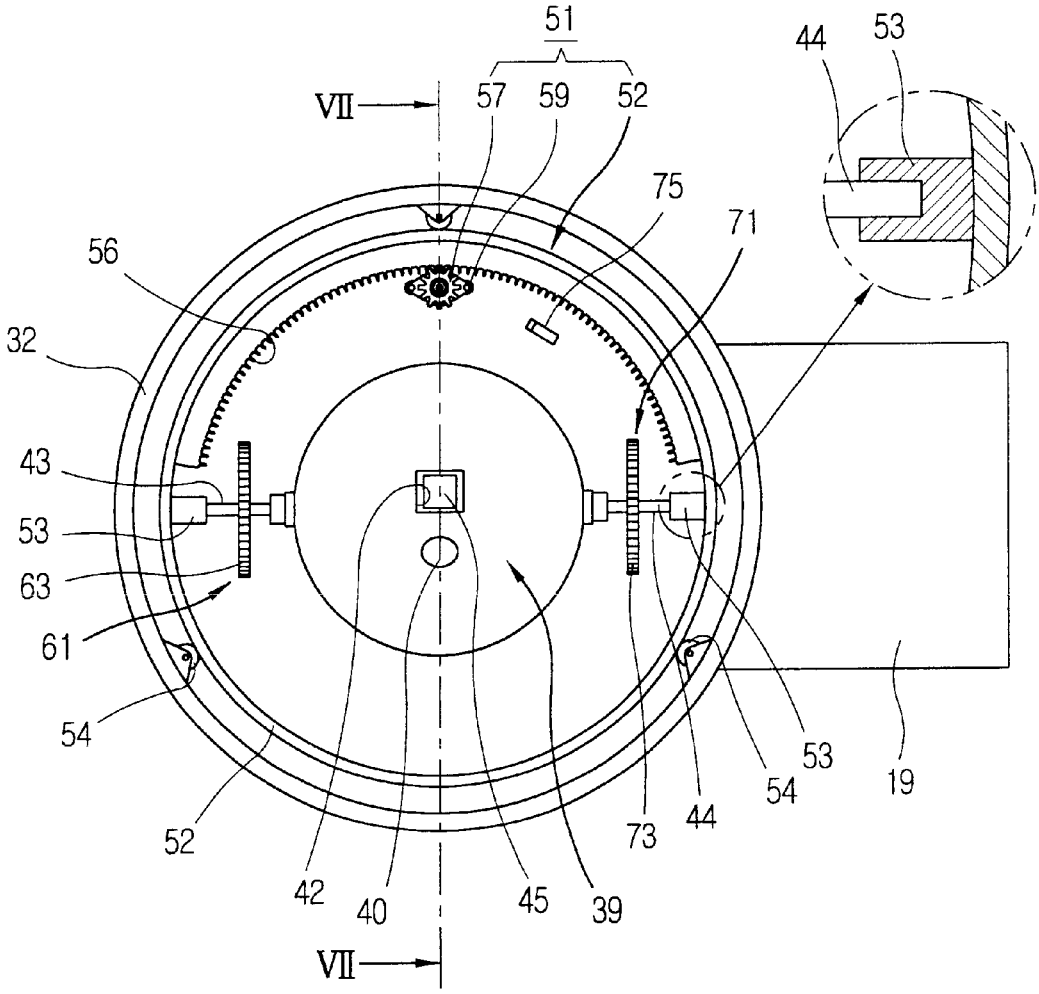
FIG. 6 is a front view illustrating the cold air jet unit of the concentration cooling apparatus in accordance with the present invention.
Figure 7:
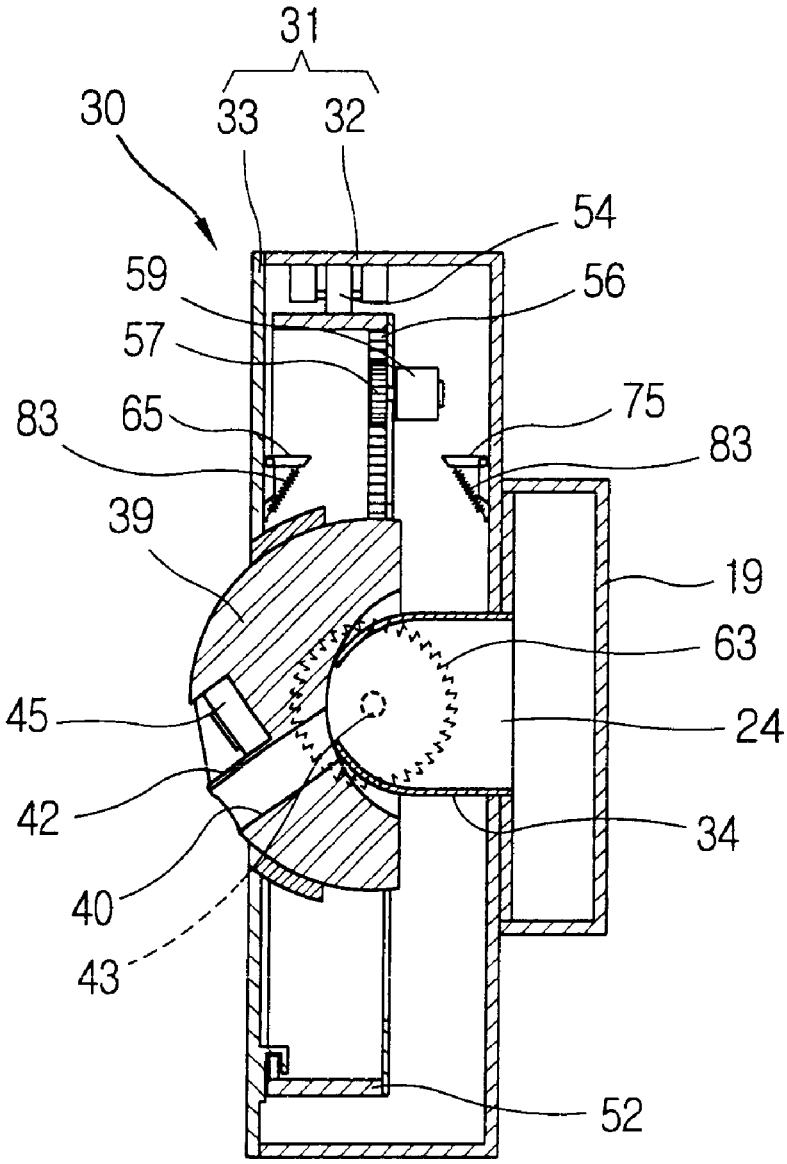
FIG. 7 is a sectional view taken along the line VII—VII in FIG. 6.

FIG. 5 is a perspective-sectional view illustrating the cold air jetting unit in accordance with the present invention, FIG. 6 is a front view illustrating the cold air jet unit of the concentration cooling apparatus in accordance with the present invention, and FIG. 7 is a sectional view taken along the line VII—VII in FIG. 6.

The cold air jet unit 30 includes a housing 32 respectively installed on the cold air guide path 19 at regular intervals; a nozzle 39 rotatively supported by the housing 32 and jetting cold air to the high-temperature load occurred region; a temperature sensor 45 installed on the front of the nozzle 39, rotating with the nozzle 39 and sensing the high-temperature load occurred region inside the chilling chamber 6; a first driving unit 51 installed on ascertain side of the housing 32 and rotating the nozzle 39 in the left and right directions; second driving units 61, 71 interlocking with the rotation of the nozzle 39 and rotating the nozzle 39 upwardly or downwardly according to the rotation direction; and a control unit 81 receiving a signal from the temperature sensor 45 and controlling the first driving unit 51.

The housing 32 is installed on each cold air guide hole 24 formed on the cold air guide path 19, and a cover 33 is installed on the front open surface of the housing 32.

In the housing 32 having a cylindrical shape, a certain side is open, and a contact protrusion 34 is formed toward the cover 33 so as to make the nozzle 39 contact rotationally.

Herein, plural first support rollers 54 for supporting the nozzle 39 rotationally are installed at the circumference of the housing 32.

In addition, the contact protrusion 34 has a through hole so as to communicate with the cold air guide hole 24 of the cold air guide path 19, the upper surface of the contact protrusion 34 is curved to facilitate the rotation in contact with the nozzle 39, and a first hot-wire 38 is installed at the circumference of the contact protrusion 34 in order to prevent the contact portions between the nozzle 39 and the contact protrusion 34 from frost.

And, in the cover 33 having the disc shape, a nozzle insertion hole 36 for inserting the nozzle 39 is formed at the central portion, and plural second support rollers 55 for supporting the nozzle 39 rotationally are installed at the circumference of the nozzle insertion hole 36, and a second hot wire 37 is installed on the internal surface of the cover 33 in the circumferential direction in order to prevent frost generation on the portion contacted to the nozzle 40.

Herein, the housing 32 and the cover 33 are combined with each other by bolts 38.

The nozzle 39 has a semi-globular shape, is inserted into the nozzle insertion hole 36 of the upper housing 32, the front portion is exposed to the front of the cover 32, and the rear inner circumference of the nozzle 39 is contacted to the contact protrusion 34 of the housing 33.

And, a cold air jet hole 40 for jetting cold air into the chilling chamber 6 is formed at a portion eccentric to the center of the nozzle 39, and a temperature sensor 45 for detecting a temperature inside the chilling chamber 6 is installed on the upper surface of the nozzle 39.

By a first and second connection rods 43, 44 extended from the both sides of the nozzle 39, the nozzle 39 is fixed to a nozzle support member 52 arranged with a certain distance from the outer circumference of the nozzle 39.

Herein, in the first and second connection rods 43, 44, the end is inserted into a connection rod receiving portion 53 formed on the inner circumference of the nozzle support member 52 so as to be rotationally supported.

In addition, the nozzle support member 52 includes a disc portion 84 open so as to receive the nozzle 39 and a cylinder portion 86 vertically extended from the disc portion 84 and having the connection rod receiving portion 53 on the inner circumference.

And, the outer circumference of the cylinder portion 86 of the nozzle support member 52 is rotationally supported by the first support rollers 54 installed at the housing 32.

Accordingly, the nozzle 39 is connected to the nozzle support member 52 by the fist and second connection rods 43, 44, is rotated up and down and is rotated in the circumferential direction by the rotation of the nozzle support member 52.

The cold air jet hole 40 is slant at a certain angle to the rear center surface of the nozzle 39, and an inlet thereof for discharging cold air is formed at a portion eccentric to the center of the nozzle 39.

And, the temperature sensor 45 is installed at a nozzle installation groove 42 formed at a portion eccentric to the nozzle 39 so as to be slant at a certain angle, it is preferable to construct the temperature sensor as an infrared sensor sensing a temperature by receiving infrared light radiated from the heat source of the front of the cold air jet hole 40.

Herein, it is preferable for the temperature sensor 45 to be slant in the same direction of the cold air jet hole 40 in order to make a direction of a temperature sensing region coincide with a cold air jet direction of the cold air jet hole 40.

The first driving unit 51 consists of a rack gear 56 fixed to the internal surface of the nozzle support member 52, a pinion gear 75 engaging with the rack gear 56; and a driving motor 59 for operating the pinion gear 57.

It is preferable for the driving motor 59 to be a stepping motor rotating at a certain step angle.

In the first driving unit 51, when the driving motor 59 generates a driving force, the nozzle support member 52 is rotated by the pinion gear 57 and the rack gear 56.

Accordingly, the nozzle 39 connected with the nozzle support member 52 through the first and the second connection rods 43, 44 is rotated in the circumferential direction.

The second driving units 61, 71 respectively consist of an upward driving unit 61 installed at the left side of the nozzle 39 and rotating the nozzle 39 upwardly and a downward driving unit 71 installed at the right side of the nozzle 39 and rotating the nozzle 39 downwardly.

The upward driving unit 61 includes an upward ratchet wheel 63 combined with the first connection rod 43, placed between the nozzle 39 and the nozzle support member 52 and having teeth formed at the outer circumference in the circumferential direction; and an upward ratchet pawl 65 installed at a certain surface of the cover 33 on a proceeding orbit of the upward ratchet wheel 63 in the rotation of the nozzle 39, permitting proceeding of the upward ratchet wheel 63 in a certain direction and permitting proceeding of the upward ratchet wheel 63 in the opposite direction after rotating the upward ratchet wheel 63 as an angle corresponding to a tooth of the upward ratchet wheel 63.

In addition, the downward driving unit 71 includes a downward ratchet wheel 73 combined with the second connection rod 44 and having teeth formed at the outer circumference in the circumferential direction; and a downward ratchet pawl 75 installed at a certain surface of the housing 32 on a proceeding orbit of the downward ratchet wheel 73 in the rotation of the nozzle 39, permitting proceeding of the downward ratchet wheel 73 in a certain direction and permitting proceeding of the downward ratchet wheel 73 in the opposite direction after rotating the downward ratchet wheel 73 as an angle corresponding to one tooth of the downward ratchet wheel 73.

The construction and the operation of the upward driving unit 61 will be described in detail with reference to accompanying FIGS. 8A and 8B.

Figure 8A:
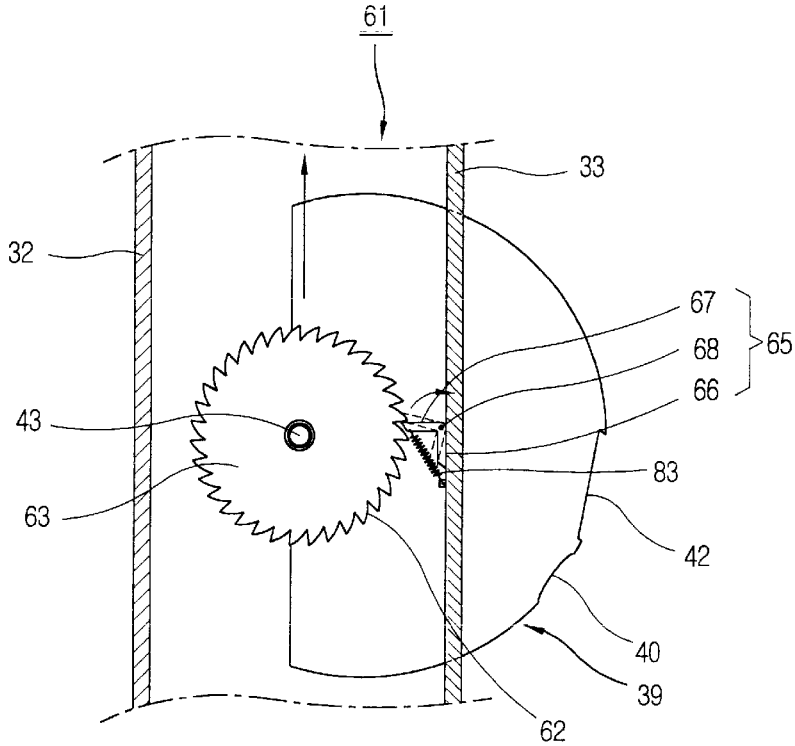
FIGS. 8A and 8B are partial sectional view illustrating an operation state of the cold air jet unit in accordance with the present invention.

As depicted in FIG. 8A, in the upward driving unit 61, each tooth of the upward ratchet wheel 63 is rounded toward the upward ratchet pawl 65 installed on the proceeding orbit of the upward ratchet wheel 63, and the opposite portion of the rounded portion is straight toward the center of the upward ratchet wheel 63.

The upward ratchet pawl 65 includes a first support portion 66 contacted to the cover 33; and a first acting portion 67 vertically extended from the first support portion 66 and in contact with a tooth of the upward ratchet wheel 63.

Herein, the first support portion 66 of the upward ratchet pawl 65 is hinge-connected to the cover 33 so as to proceed by pushing the upward ratchet pawl 65 when the upward ratchet wheel 63 proceeds in the clockwise direction.

In addition, in the first acting portion 67, a portion directly contacted to each tooth of the upward ratchet wheel 63 is rounded at a certain angle toward the tooth of the upward ratchet wheel 63 so as to permit the proceeding of the upward ratchet wheel 63 in the clockwise direction, and the opposite portion is perpendicular to the cover 33 so as to meet with the tooth of the upward ratchet wheel 63 when the upward ratchet wheel 63 proceeds in the counter clockwise direction after passing the upward ratchet pawl 65.

In the meantime, after being pushed by the proceeding of the upward ratchet wheel 63, the upward ratchet pawl 65 is returned to an original state by gravity, and it is preferable to arrange an elastic support means 83 between the first acting portion 67 and the cover 33 in order to provide a restoring force to the upward ratchet pawl 65.

Figure 9:
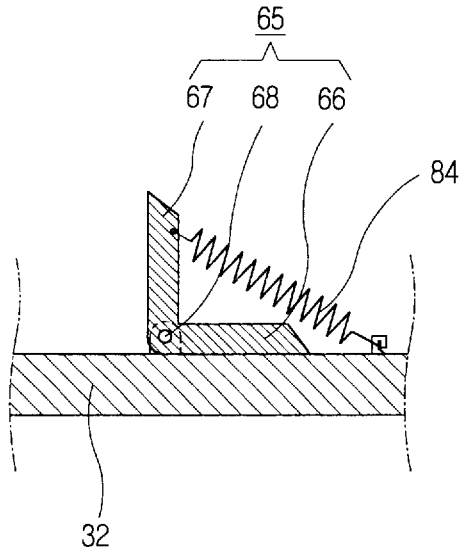
FIGS. 9 and 10 are sectional views illustrating a ratchet pawl of the cold air jet unit in accordance with the present invention.
Figure 10:
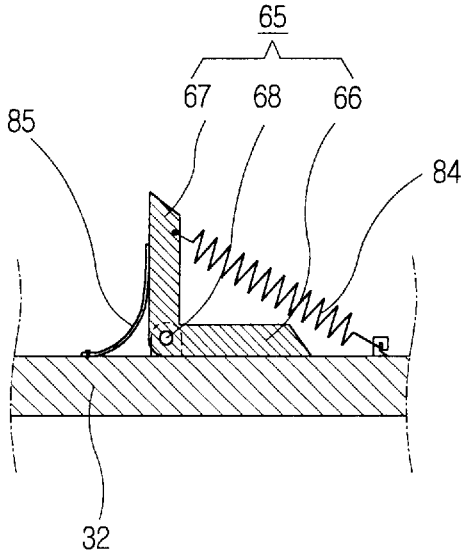

As depicted in FIGS. 9 and 10, the elastic support means 83 can be a coil spring 84 connecting the first acting portion 67 with the cover 33 or a plate spring 85 installed on the perpendicular surface of the first acting portion 67 and the surface of the cover 33.

The operation of the upward driving unit 61 will be described.

First, when the nozzle 39 is rotated in the clockwise direction (in FIG. 6) by the first driving unit 51, the upward ratchet wheel 63 is moved along the proceeding orbit in connection with the first connection rod 43.

And, because one of the teeth of the upward ratchet wheel 63 is contacted to the first acting portion 67 of the upward ratchet pawl 65 arranging on the proceeding orbit of the upward ratchet wheel 63, the upward ratchet pawl 65 is pushed by the proceeding force of the upward ratchet wheel 63.

Accordingly, the upward ratchet wheel 63 proceeds continually while pushing the upward ratchet pawl 65.

In the meantime, when the upward ratchet wheel 63 gets out of the upward ratchet pawl 65, the upward ratchet pawl 65 is returned to the original state by gravity or the elastic support means 83.

Figure 8B:
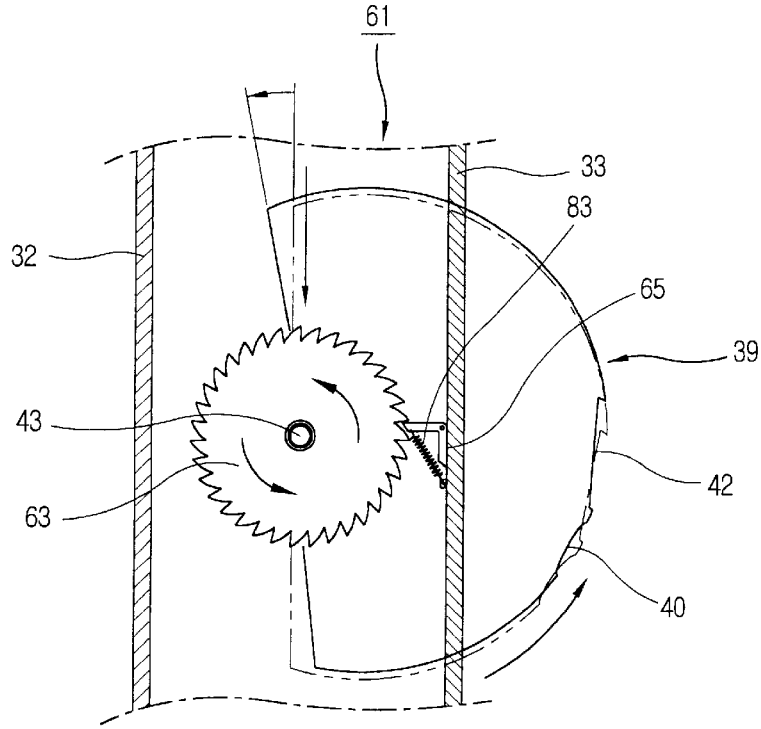

And, as depicted in FIG. 8B, when the nozzle 39 is rotated reversely, namely, in the counter clockwise direction, the upward ratchet wheel 63 is moved along the counter clockwise direction obit.

Herein, the tooth of the upward ratchet wheel 63 pushes the first acting portion 67 of the upward ratchet pawl 65, however, the first acting portion 67 is supported by the first support portion 66, it is not pushed by that, and accordingly the tooth of the upward ratchet wheel 63 is caught on the first acting portion 67.

By the catch, the upward ratchet wheel 63 turns on its axis in the counter clockwise direction (in FIG. 8B).

Accordingly, the nozzle 39 connected to the upward ratchet wheel 63 through the first connection rod 43 is rotated upwardly by the rotation of the upward ratchet wheel 63, by repeating the rotation as request times, the cold air jet hole 40 can be upwardly rotated toward a request portion.

Figure 11A:
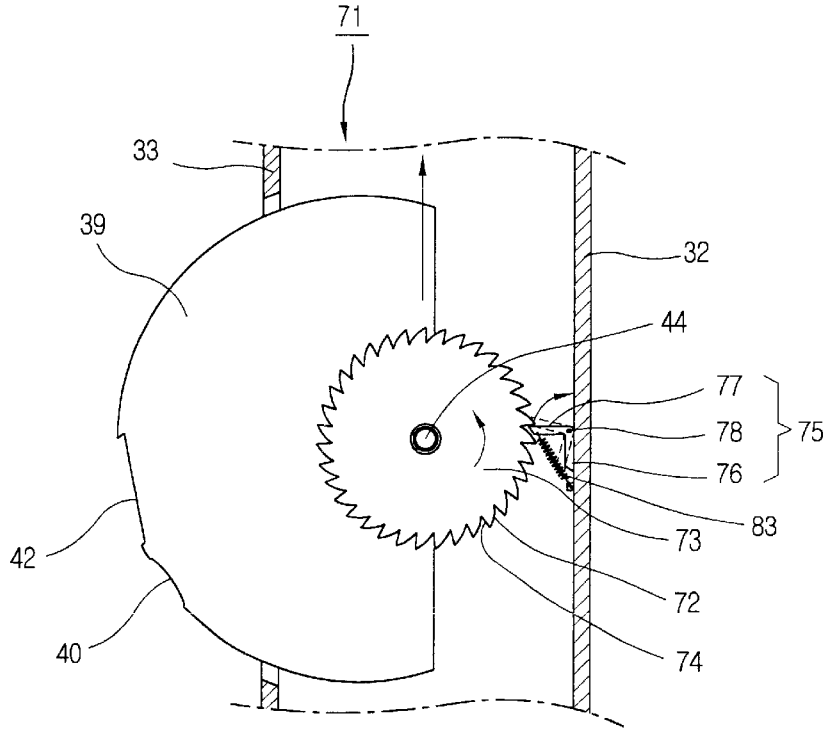
FIGS. 11A and 11B are partial sectional views illustrating an operation state of the cold air jet unit in accordance with the present invention.

In the meantime, the construction and the operation of the downward driving unit 71 will be described in detail with reference to accompanying FIGS. 11A and 11B.

In the downward driving unit 71, each tooth of the downward ratchet wheel 73 is rounded toward the downward ratchet pawl 75 installed on the proceeding orbit of the downward ratchet wheel 73, and the opposite portion of the rounded portion is straight toward the center of the downward ratchet wheel 73.

Herein, the downward ratchet pawl 75 is hinge-connected to the housing 32 so as to make the downward ratchet wheel 73 proceed in the counter clockwise direction (in FIG. 6) by pushing the downward ratchet pawl 75.

The downward ratchet pawl 75 includes a second support portion 76 contacted to the housing 32; and a second acting portion 77 vertically extended from the second support portion 76 and in contact with each tooth of the downward ratchet wheel 73.

Herein, in the second acting portion 77, a portion directly contacted to each tooth of the downward ratchet wheel 73 is rounded at a certain angle toward the tooth of the upward ratchet wheel so as to permit the proceeding of the downward ratchet wheel 73 in the counter clockwise direction, and the opposite portion is perpendicular to the housing 32 so as to meet with the tooth of the downward ratchet wheel 73 when the downward ratchet wheel 73 proceeds in the clockwise direction after passing the downward ratchet pawl 75.

In the meantime, after being pushed by the proceeding of the downward ratchet wheel 73, the downward ratchet pawl 75 is returned to the original state by gravity, and it is preferable to arrange an elastic support means 83 between the second acting portion 77 and the housing 32 in order to provide a restoring force to the downward ratchet pawl 75.

The operation of the downward driving unit 71 will be described.

First, when the nozzle 39 is rotated in the counter clockwise direction by the first driving unit 51, the downward ratchet wheel 73 is moved along the proceeding orbit in connection with the second connection rod 44.

And, because one of the teeth of the downward ratchet wheel 73 is contacted to the second acting portion 77 of the downward ratchet pawl 75 arranging on the proceeding orbit of the downward ratchet wheel 73, the downward ratchet pawl 75 is pushed by the proceeding force of the downward ratchet wheel 73.

Accordingly, the downward ratchet wheel 73 proceeds in the counter clockwise direction while pushing the downward ratchet pawl 75.

In the meantime, when the downward ratchet wheel 73 gets out of the downward ratchet pawl 75, the downward ratchet pawl 75 is returned to the original state by gravity or the elastic support means 83.

Figure 11B:
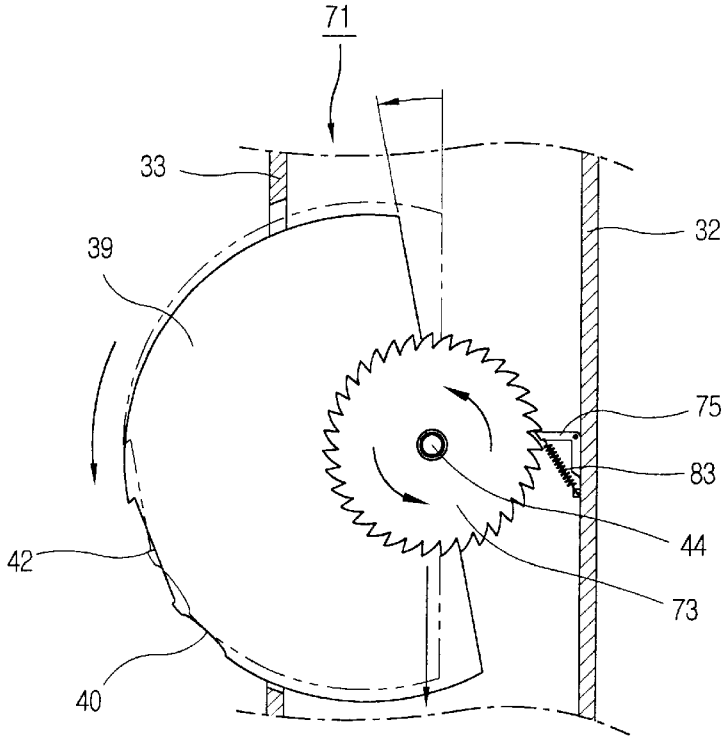

And, as depicted in FIG. 11B, when the nozzle 39 is rotated reversely, namely, in the clockwise direction, the downward ratchet wheel 73 is moved along the clockwise direction obit.

Herein, the tooth of the downward ratchet wheel 73 pushes the second acting portion 77 of the downward ratchet pawl 75, however, because the second acting portion 77 is supported by the second support portion 76, it is not pushed by that, and accordingly the tooth of the downward ratchet wheel 73 is caught on the second acting portion 77.

By the catch, the downward ratchet wheel 73 turns on its axis in the counter clockwise direction (in FIG. 11B).

Accordingly, the nozzle 39 connected to the downward ratchet wheel 73 through the second connection rod 44 is rotated upwardly by the rotation of the downward ratchet wheel 73, by repeating the rotation as request times, the cold air jet hole 40 can be upwardly rotated toward a request portion.

Figure 12:
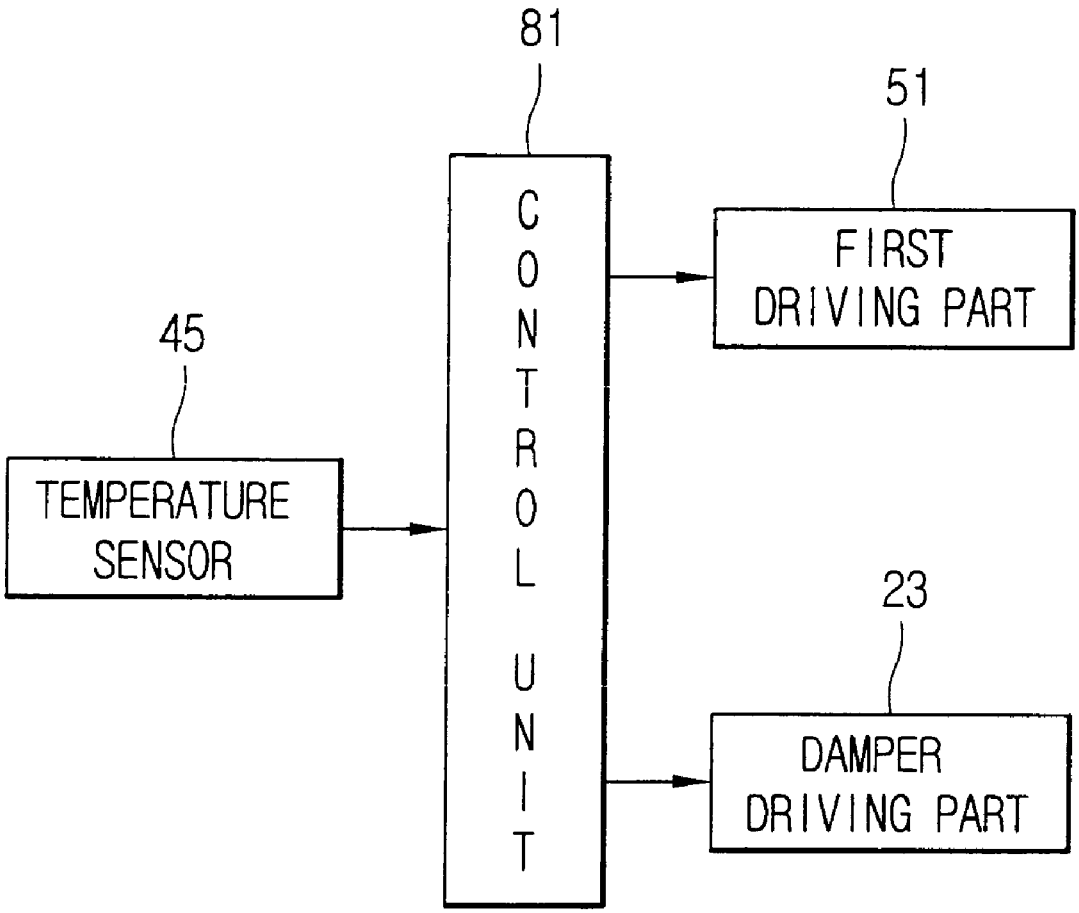
FIG. 12 is a control block diagram illustrating the concentration cooling apparatus in accordance with the present invention.

In the meantime, as depicted in FIG. 12, the control unit 81 judges whether a high temperature load occurs according to a signal applied from the temperature sensor 45, controls the first driving unit 51 and a damper driving part 23 which controls a position of the damper 20.

Hereinafter, the operation of the refrigerator having the concentration cooling apparatus in accordance with the present invention will be described.

First, when the refrigerating cycle and the fan 20 are operated, air cooled while passing the refrigerating cycle is discharged into the freezing chamber 4 through the cold air discharge hole 13 formed at the panel 14 and performs the cooling operation by circulating the freezing chamber 4 and is supplied to the chilling chamber 6 through the cold air supply path 15 formed at the separation wall 8.

The cold air supplied to the cold air supply path 15 flows into the cold air guide path 19, is discharged into the chilling chamber 6 through the cold air discharge holes 16 formed on the cold air discharge duct 17 and performs the cooling operation. Herein, the damper installed on the cold air supply path 15 is operated at the third position (N), and accordingly the cold air is discharged into the chilling chamber 6.

In the meantime, when the driving motor 59 is operated by the control unit 81 of the cold air jet unit 30, the driving force of the driving motor 50 is transmitted to the driving gear 57, and the nozzle support member 52 engaging with the driving gear 57 is rotated.

And, the nozzle 39 connected to the nozzle support member 52 through the first and second connection rods 43, 44 is rotated, and simultaneously the ratchet wheels 63, 73 respectively connected to the first and second connection rods 43, 44 are moved in the rotation direction of the nozzle 39.

Accordingly, the nozzle 39 is rotated by the second driving units 61, 71 while being repeatedly rotated in the clockwise direction and counter clockwise direction by the first driving unit 51.

Herein, the temperature sensor 45 installed on the front of the nozzle 39 senses a temperature inside the chilling chamber 6 and applies it to the control unit 81.

In the operation, when a high temperature load occurs inside the chilling chamber 6, the damper is operated at the second position (M), cold air supply to the cold air discharge duct 17 is cut off, cold air is supplied only to the cold air guide path 19, and the cold air jet unit 30 is operated in order to jet cold air intensively onto the high temperature load occurred region.

In more detail, the control unit 81 of the cold air jet unit 30 makes the cold air jet hole 40 of the nozzle 39 face the pertinent region (high temperature load occurred region) by controlling the driving motor 49 and performs the concentrated cooling onto the pertinent region, and accordingly a temperature inside the chilling chamber 6 can be uniformly maintained in a short time.

Herein, the nozzle 39 is rotationally supported by the support rollers 54 installed at the cover 33.

Advantageous of the concentration cooling apparatus of the refrigerator in accordance with the present invention will be described.

In the concentration cooling apparatus of the refrigerator in accordance with the present invention, by installing a nozzle having plural cold air jet holes on the side wall of a chilling chamber and discharging cold air intensively onto a high temperature load occurred region inside the chilling chamber, instant cooling can be performed, and accordingly a temperature inside the chilling chamber can be uniformly maintained in a short time.

In addition, in the concentration cooling apparatus of the refrigerator in accordance with the present invention, by including a first driving unit for rotating the nozzle up and down and a second driving unit for rotating the nozzle in the circumferential direction, a temperature sensing region of a temperature sensor can be widen, and accordingly it is possible to cope with a high temperature load occurrence inside a chilling chamber positively.

What is claimed is:

1. A concentration cooling apparatus of a refrigerator, comprising:

housings respectively installed to at least one cold air guide path formed at the side wall of a chilling chamber in order to guide cold air to the side wall of the chilling chamber;

a nozzle rotatably supported by the housings and jetting cold air intensively to a high-temperature load occurred region inside the chilling chamber when the high temperature load occurs at the certain region;

a nozzle support member arranged with a certain distance from the outer circumference of the nozzle, connected to the nozzle through a connection rod extended from the both sides of the nozzle and supporting the nozzle rotatably;

an infrared temperature sensor installed on the front of the nozzle, rotating with the nozzle and sensing the high-temperature load occurred region;

a first driving unit for rotating the nozzle in the circumferential direction by rotating the nozzle support member; and a second driving unit for rotating the nozzle up and down by rotating the connection rod interlocked with the rotation of the nozzle and rotated according to the circumferential rotation direction of the nozzle.

2. The apparatus of claim 1, wherein the housing is installed on the cold air guide path so as to communicate with each other, and a cover is installed on an open front surface of the housing so as to expose the nozzle to the front thereof.

3. The apparatus of claim 2, wherein the housing has a cylindrical shape open to the cover side, includes a contact protrusion formed at the center toward the front so as to contact with the nozzle rotatably and includes plural first support rollers installed on the circumference in order to support the nozzle support member rotatably.

4. The apparatus of claim 2, wherein the cover is disc-shaped having a nozzle insertion hole for receiving the nozzle rotatably, and plural second support rollers are installed at the rear surface of the cover in order to support the nozzle rotatably.

5. The apparatus of claim 2, wherein the nozzle is inserted into the nozzle insertion hole of the cover, the front of the nozzle is exposed to the chilling chamber, the rear of the nozzle is contacted to the outer circumference of the contact protrusion of the housing, a cold air jet hole for jetting cold air from the cold air guide path into the chilling chamber is eccentrically formed on the front of the nozzle, and a sensor receiving portion for receiving the temperature sensor is formed onto the upper surface of the cold air jet hole.

6. The apparatus of claim 5, wherein the front of the nozzle exposed to the chilling chamber is a semi-globular shape.

7. The apparatus of claim 1, wherein the first driving unit includes:

a rack gear fixed to the internal surface of the nozzle support member;

a pinion gear engaging with the rack gear; and a driving motor for operating the pinion gear.

8. The apparatus of claim 7, wherein the driving motor is a stepping motor.

9. The apparatus of claim 1, wherein the second driving unit includes:

an upward driving unit installed at a certain side of the nozzle and rotating the nozzle upwardly by rotating the connection rod; and a downward driving unit installed at the opposite side of the upward driving unit and rotating the nozzle downwardly by rotating the connection rod.

10. The apparatus of claim 9, wherein the upward driving unit includes:

an upward ratchet wheel combined with the connection rod and having teeth formed at the outer circumference; and an upward ratchet pawl installed at a certain side of the cover on a proceeding orbit of the upward ratchet wheel in the circumferential rotation of the nozzle, permitting proceeding of the upward ratchet wheel in a certain direction and permitting proceeding of the upward ratchet wheel in the opposite direction after rotating the upward ratchet wheel as an angle corresponding to a tooth of the upward ratchet wheel.

11. The apparatus of claim 10, wherein the upward ratchet wheel proceeds in the certain direction by pushing the upward ratchet pawl, and the upward ratchet wheel is caught on the upward ratchet pawl in the opposite direction proceeding.

12. The apparatus of claim 10, wherein the upward ratchet pawl is movably hinge-connected to the cover, and an elastic support means is arranged between the upward ratchet pawl and the cover in order to provide an elastic force toward the opposite direction of the proceeding of the upward ratchet wheel.

13. The apparatus of claim 12, wherein the elastic support means is a coil spring.

14. The apparatus of claim 12, wherein the elastic support means is a plate spring.

15. The apparatus of claim 10, wherein the upward ratchet pawl is hinge-connected to the cover so as to be returned into an original state by gravity after the proceeding of the upward ratchet wheel.

16. The apparatus of claim 9, wherein the downward driving unit includes:

a downward ratchet wheel combined with the connection rod and having teeth formed at the outer circumference; and a downward ratchet pawl installed at a certain side of the housing on a proceeding orbit of the downward ratchet wheel in the rotation of the nozzle, permitting proceeding of the downward ratchet wheel in a certain direction and permitting proceeding of the downward ratchet wheel in the opposite direction after rotating the downward ratchet wheel as an angle corresponding to a tooth of the downward ratchet wheel.

17. The apparatus of claim 16, wherein the downward ratchet wheel proceeds in the certain direction by pushing the downward ratchet pawl, and the downward ratchet wheel is caught on the downward ratchet pawl in the opposite direction proceeding.

18. The apparatus of claim 16, wherein the downward ratchet pawl is movably hinge-connected to the cover, and an elastic support means is arranged between the downward ratchet pawl and the cover in order to provide an elastic force toward the opposite direction of the proceeding direction of the downward ratchet wheel.

* * * * *